US005414394A

United States Patent [19]

Gamand et al.

[11] Patent Number: 5,414,394

[45] Date of Patent: May 9, 1995

[54] MICROWAVE FREQUENCY DEVICE COMPRISING AT LEAST A TRANSITION BETWEEN A TRANSMISSION LINE INTEGRATED ON A SUBSTRATE AND A WAVEGUIDE

[75] Inventors: Patrice Gamand, Yerres; Christophe Cordier, Limeil-Brevannes, both of France

[73] Assignee: U.S. Philips Corporation, New York, N.Y.

[21] Appl. No.: 167,379

[22] Filed: Dec. 15, 1993

[30] Foreign Application Priority Data

Dec. 29, 1992 [FR] France ..... 92 15837

[51] Int. Cl.[6] ..... H01P 5/107

[52] U.S. Cl. ..... 333/26; 333/34

[58] Field of Search ..... 333/26, 33, 34

[56] References Cited

U.S. PATENT DOCUMENTS

| | | | |
|---|---|---|---|
| 4,409,566 | 10/1983 | Patton et al. | 333/26 |
| 4,453,142 | 6/1984 | Murphy | 333/26 |
| 4,716,386 | 12/1987 | Lait | 333/26 |
| 5,235,300 | 8/1993 | Chan et al. | 333/26 X |

OTHER PUBLICATIONS

Shih et al., "Waveguide-To-Microwave Transitions For Millimeter-Wave Applications", 1988 IEEE MTT-S Digest, P-4, pp. 473-475.

*Primary Examiner*—Paul Gensler
*Attorney, Agent, or Firm*—Robert J. Kraus

[57] ABSTRACT

Microwave frequency device comprising at least a transition between a transmission line (24) integrated on a substrate (23) of a hard material, disposed in a first microwave frequency cavity (31), and waveguides (100) having a second microwave frequency cavity (102*a*, 102*b*). This transition comprises an open end (25*a*, 25*b*) of the integrated line which end forms a probe inserted over a length l into the cavity of the waveguide, at a distance D from a short-circuit (42*a*, 42*b*) which closes off the end of the waveguide. This transition also comprises an impedance adapting system with, on the one hand, a dimensional restriction (33*a*, 33*b*) of the first microwave frequency cavity (31) which is perpendicular to the direction of propagation over a given length L parallel with the direction of propagation in the integrated line (24) and comprises, on the other hand, a restriction of the dimensions of the cross section of the waveguide areas (22*a*, 32*a*; 22*b*, 32*b*) between the probes (25*a*, 25*b*) and the short-circuit planes (32*a*, 42*b*).

16 Claims, 2 Drawing Sheets

MICROWAVE FREQUENCY DEVICE COMPRISING AT LEAST A TRANSITION BETWEEN A TRANSMISSION LINE INTEGRATED ON A SUBSTRATE AND A WAVEGUIDE

BACKGROUND OF THE INVENTION

The invention relates to a microwave frequency device comprising at least a transition between a transmission line integrated on a substrate, disposed in a first microwave frequency cavity, and a waveguide formed by a second microwave frequency cavity, this transition comprising an open end of the integrated line which end forms a probe inserted into the cavity of the waveguide, at a distance from a short-circuit which closes off the end of the waveguide, this transition further comprising an impedance adapting system.

The invention finds its application in microwave frequency devices which comprise integrated circuits and waveguides, which are to be connected to each other. The invention is useful, for example, in the fields of television aerials and automotive radar.

A transition between a waveguide and a microstrip line is already known from the publication in "1988 IEEE MTF-S Digest, P.4, pp. 473–474", entitled "WAVEGUIDE-TO-MICROSTRIP TRANSITIONS FOR MILLIMETER-WAVE APPLICATIONS" by Yi-Chi SHIH, Thuy-Nhung TON, and Long Q. BUI, of Hughes Aircraft Company, Microwave Products Division, TORRANCE, Calif., U.S.A.

This publication describes a transition between a microwave frequency microstrip line inserted into a first microwave frequency cavity, and a waveguide formed by a second microwave frequency cavity. This transition has an open end of the integrated line which extends into the waveguide perpendicularly to the waveguide propagation axis, through an opening made in a wall of the waveguide. In this manner the propagation planes of the electric field $\bar{E}$ of the probe and of the waveguide coincide. This transition further includes an impedance adapting system applied to the integrated line which system consists of a narrowing over a specific length of the microstrip at the surface of the substrate. This length is provided to form a quarter wave adapter to bring the input impedance of the probe to 50 Ω. The end of the waveguide forming the short-circuit is situated at a distance L from the microstrip conductor and the end forming the probe of the latter extends into the waveguide to a depth D. By minutely adjusting these dimensions, the known device can be a broadband device in the K band (18 to 26 GHz).

To date planar integrated circuits operating with microwave frequencies between 40 GHz and 100 GHz have been used more and more in the field of telecommunications. These integrated circuits generally include planar transmission lines, for example, microstrip lines and are interconnected or connected to aerial elements by means of waveguides.

These planar integrated circuits operating with such high frequencies require appropriate housings which are capable of retaining their performance. They additionally require devices capable of realizing a transition between their input/output stubs and the connecting waveguides.

As regards the housings, they are to present eminent microwave qualities, which qualifies are specific of the operating frequency of the circuits. The accent is to be laid particularly on the tolerances of the ground stubs and on the tolerances of the microwave frequency links between the input/output stubs of the integrated circuits and the external elements, links which are to be realized by, for example, gold conducting wires which are very short and very fine and are bonded on the various stubs, for example, by means of thermocompression. The accent is also to be laid on the mechanical resistance and the imperviousness of the housings which are to safeguard the integrated circuits from dust and from corrosion, which hazards are susceptible of deteriorating the electrical qualities of the housings; in effect, numerous microwave frequency circuits used in telecommunications are positioned on aerial mounts or on vehicles and are thus subject to bad weather conditions.

As regards the devices that realize a transition from a waveguide to a transmission line, they are to be compatible with both the standard waveguides and the microwave frequency inputs/outputs of the integrated circuits. Furthermore, these devices are to present all the mechanical qualities and electrical qualities defined hereinbefore for the housings. More particularly, these devices are to be sealed and not to cause sealing discontinuities occurring between the waveguides and the integrated circuits. The electrical connections between this type of transition and a given integrated circuit are to meet the requirements defined hereinbefore relating to the tolerances of the microwave frequency stubs and ground stubs.

In addition, these transition devices are to present a good adaptation, in a wide frequency band, at frequencies as high as 40 Ghz to 100 GHz.

The device known from said document does not yield a waveguide-to-transmission line transition:

- that permits a sealed link between a waveguide and an integrated circuit,
- that makes it possible to manufacture microwave frequency links to an integrated circuit that have the required tolerances,
- that presents an adaptation to the considered microwave frequencies which is easy to realize from a point of view of manufacturing.

In effect, with the prior-art waveguide-to-transmission line transition device it is not possible to provide that the sealing required for the microstrip line is not interrupted. This microstrip line is realized on a substrate by way of an integrated circuit technique. The cavity embedding the line is thus to be sealed relative to the waveguide for reasons given hereinbefore. The plane substrate supporting the end that forms a probe extended into the waveguide does not close off the cavity of the waveguide because the transversal dimension of the substrate is smaller than the width "a" of the cross section of the waveguide.

Then, the electrical match is hard to realize. To realize the transition, the line is to extend into the waveguide cavity of the over length D, which is smaller than dimension "b" of the waveguide. The end of the line thus forms an open circuit that radiates. Therefore, a metallic plane, forming a short-circuit for the waveguide and closing off this waveguide perpendicularly to the direction of propagation so as to ensure a maximum propagation of the radiated power in this transition, is judiciously to be disposed at a distance $L=\lambda/4$ from said line. The radiation can thus be controlled by the length L of the short-circuit which is fixed. This transition makes it necessary to include an impedance transformer that consists of a narrowing of the microstrip conductor near to the probe. This type of technology is hard to implement in industry when the designer with respect to microwave frequency devices is confronted with the problem of realizing consumer devices, as is the case in the field of television or automotive vehicles. Thus it is necessary that the performance obtained is not vulnerable to the manufacturing tolerances; in the case of this narrowing of the conductor, it is.

Furthermore, the substrate used for realizing the prior-art device is made of a supple material (Duroid) which has several particular features. In the prior-art device this supple substrate is used for two reasons: the first reason is that the transversal dimensions of the substrate are to be very small for reasons of adaptation, and that only a supple substrate can support such small dimensions; the second reason is that the supple substrates have a low dielectric constant of the order of 2, whereas the hard substrates, such as alumina, have a higher dielectric constant of the order of 8 to 10, which is remote from the dielectric constant of air (1). It happens that this supple substrate is a drawback for realizing microwave frequency electrical connections by very fine gold wires because of its suppleness, the technology of fixing wires by thermocompression cannot be used. Realising interconnections between a supple substrate and a chip or an integrated circuit of a hard substrate is a problem that the expert has so far not been able to solve. This type of interconnection is thus to be avoided if the designer of microwave frequency devices wishes to count on a good manufacturing output.

The dimensions used in the state of the art are to be considered well. With reference to FIG. 1A of said document, the large dimension "a" of the waveguide is 3.8 min. The substrate inserted into the waveguide is much narrower: its width is about half of "a", that is 1.9 min. The distance between the two waveguides in the double-transition structure also described in said publication is 18 min. In this prior-art arrangement the dimensions of the substrate are thus ultimately 1.9 mm×18 mm. These dimensions make the substrate very fragile. Therefore, in the prior-art arrangement the substrate cannot be manufactured of a material other than a supple material.

SUMMARY OF THE INVENTION

It is thus an object of the invention to avoid these drawbacks and, more particularly, to provide a transition device between a waveguide and a transmission line, capable of sheltering an integrated circuit and with the performance required for a housing; suitable for permitting of a connection between the transmission line and the microwave frequency stub of the housing which is simple to manufacture, and reliable; and which also ensures the sealing of the transmission line, of the integrated circuit and of the link between these two elements.

This object is achieved by the device defined in the opening paragraph and furthermore characterized, in that first the substrate is of a material having a high dielectric constant and in that secondly the impedance adapting system comprises, on the one hand, a dimensional restriction of said first microwave frequency cavity which is perpendicular to the direction of propagation over a length parallel with the direction of propagation in the integrated line, and comprises, on the other hand, a restriction of the dimensions of the cross section of the waveguide in the area between the plane of the probe and the short-circuit plane.

This device shows various advantages which are mutually interactive:

- the adapting means which are applied to the cavity of the waveguide and also to the cavity of the line permit using a substrate that has about twice the transversal dimension of that of the state of the art, which results in that this substrate can be hard;
- the substrate having a high dielectric constant could be a hard material which permits obtaining bonds on the conductor of the line by means of thermocompression and thus obtaining good microwave frequency contacts;
- the substrate which is hard and wider than the known substrate is suitable for extending crosswise over the whole cross section of the waveguide to close off the waveguide and thus seal the cavity of the line, this closing off being all the more simple if the cavity of the waveguide has small dimensions in this area.

In an embodiment this device is characterized in that in the area of the probe this substrate covers the whole cross section of the waveguide to seal off the cavity of the line.

The advantages resulting therefrom are that:

- the sealed cavity of the line can accommodate an integrated circuit;
- this integrated circuit will have a high-quality microwave frequency link to the line because of the hard substrate;
- the adapting system of this transition device is better than the prior-art adapter;
- the operating frequency band of this transition device can also be widened considerably.

BRIEF DESCRIPTION OF THE DRAWING

The invention will be described in detail hereinafter with reference to the appended diagrammatic drawing Figures of which.

DESCRIPTION OF THE PREFERRED EMBODIMENTS

Figure 1A:
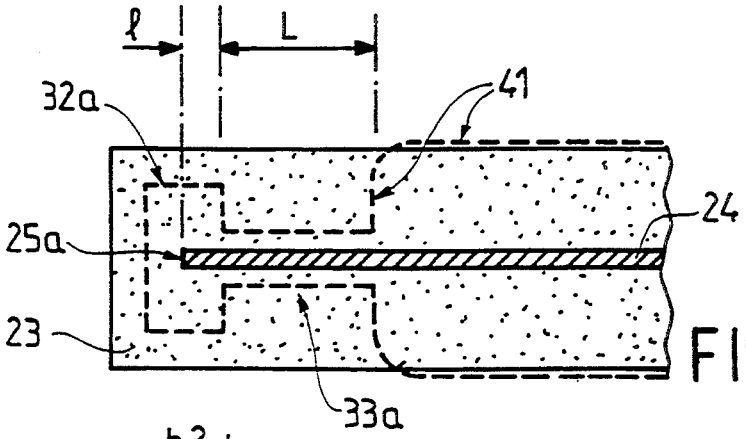
FIG. 1A represents a top view of the side of the substrate with the conductor of the transmission line and, in a dashed line, the projection of the microwave frequency cavity section onto this side of the substrate.
Figure 1B:
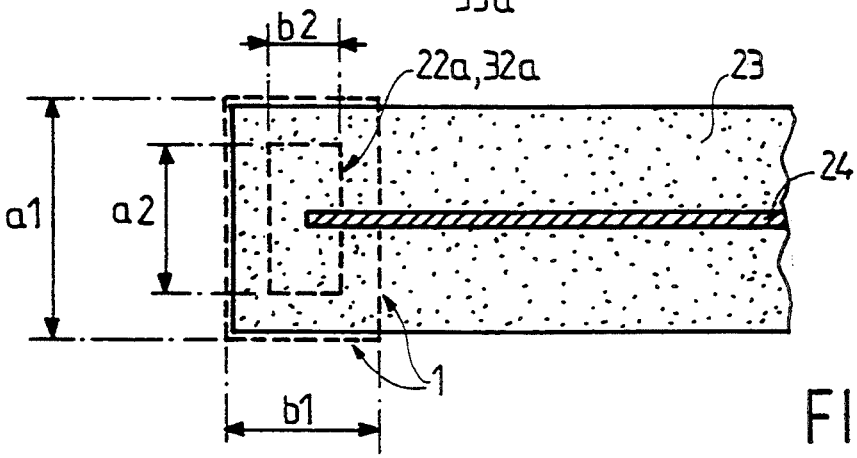
FIG. 1B represents a top view of the side of the substrate with the conductor of the transmission line and, in a dashed line the projection of the cavity of the waveguide onto the opposite side of the substrate.
Figure 1C:
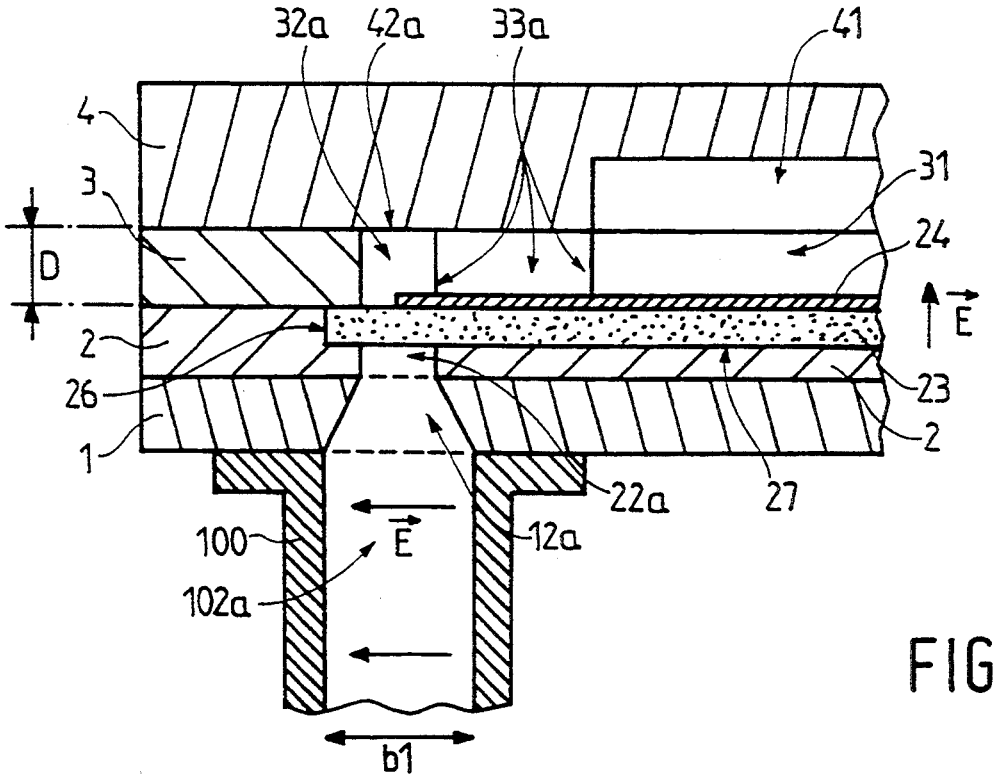
FIG. 1C represents in a sectional view of the transition device between a waveguide and a transmission line of the microstrip type as shown in FIGS. 1A and 1B.

FIG. 1C shows in a sectional view a transition device between a waveguide and a transmission line. The waveguide itself is constituted by the hollow metallic piece 100 which has a rectangular cross section: the small side having dimension b1 lies in the plane of FIG. 1C and the large side having dimension a1 is perpendicular to the plane of FIG. 1C. The electric field $\vec{E}$ symbolized by an arrow is parallel with the small side b1 and is propagated in the rectangular cavity 102*a*.

The transition comprises an area in the form of a metallic base or lower sheet 1 connected by fixing means (not shown), for example screws, on one side to waveguide 100 and on the other side to support 2 of the substrate 23 of the transmission line. The lower sheet 1 has an opening 12*a* in the extension to the opening 102*a* of the waveguide and the metallic support 2 has an opening 22*a* in the extension to the opening 12*a* of the lower sheet.

Furthermore, the transition comprises a metallic sheet 3 called upper intermediate sheet which is positioned and fixed on top of support 2, the substrate 23 itself being disposed on the support and the conductor 24 of the transmission line being disposed on the substrates upper surface. This upper intermediate sheet 3 has an opening 32*a* in the extension to the openings 102*a*, 12*a*, 22*a* of the underlying parts.

The adapting system of the transition includes a narrowing of the waveguide dimensions in the part situated between the transmission line and the short-circuit plane. Thereto the opening 22*a* of the support sheet 2 and the opening 32*a* of the upper intermediate sheet 3 are rectangular while the small side of the rectangle has the dimension $b2<b1$ and is parallel with b1 and the small side of the opening 102*a* of the waveguide; and the large side of the rectangle has the dimension $a2<a1$ and is parallel with a1 and the large side of the opening 102*a* of the waveguide. The transition between the waveguide itself 102*a*, having dimensions $a1\times b1$, and the narrowed upper part formed by the openings 22*a* , 32*a* having dimensions $a2\times b2$, is formed by the opening 12*a* of the lower sheet 1, this opening 12*a* having the form of a funnel with a large opening size equal to $a1\times b1$ of the waveguide, and a small opening size equal to $a2\times b2$ of the narrowed upper part.

FIGS. 1A and 1B represent a top view of the substrate 23. The transmission line is realized in what is commonly referred to as microstrip technology, which comprises a substrate 23, a line conductor formed by microstrip 24 disposed on the upper surface of the substrate 23 and a ground plane formed on the opposite surface.

The waveguide-to-transmission line transition is effected by extending the end 25*a* of the conductor 24 over a length e into the cavity of the waveguide formed by the openings 102*a*, 12*a*, 22*a*, 32*a*. In this cavity the maximum power is transmitted between the waveguide and the line, because the short-circuit 42*a* lies at a distance D from the end 25*a* of the line that forms the probe. This distance D depends on the thickness of the upper intermediate part 3.

In FIG. 1A is shown in a dashed line the projection of the cavity openings 32*a*, 33*a* and 41 made in the intermediate sheet 3 for the microwave frequency line formed by the substrate 23 and the conductor 24. In order that the cavity opening 32*a* is rectangular or practically rectangular, so that it creates the sought adaptation, the cavity opening 33*a* is narrow over a certain length L parallel with the conductor 24 of the line. The length L over which the narrowing takes place, and the dimension of the narrowing itself are not critical.

The substrate 23 is disposed in a groove 26 which is made in the support 2 and has the dimensions of the substrate 23. As shown in FIGS. 1A and 1B this substrate is rectangular and its width is nearly equal to the large dimension a1 of the waveguide itself.

In FIG. 1B is shown in a dashed line the projection of the cavity openings 22*a* and 32*a* having narrowed dimensions $a2\times b2$, and the projection of the cavity 102*a* of the waveguide having the dimensions $a1\times b1$.

The substrate 23 to realize the microstrip transmission line is chosen to be of a hard material, for example, quartz or alumina or a ceramic material. In a general way the dielectric constant of the hard materials for microwave frequency substrates is of the order of 8 to 10, that is to say, much larger than that of supple materials which is of the order of 2; whereas the electric constant of air is 1.

As a result, there is a large change of operation in the microwave frequency mode.

In the embodiment for the waveguide-to-transmission line transition described with reference to FIGS. 1, the hard substrate 23 is selected to have dimensions suitable for closing off the cavity openings 102*a*, 12*a* and 22*a* of the waveguide in the upper part of the opening 22*a*. This is possible because the dimensions of this substrate are larger than those of this opening.

It appears that the selection of a hard substrate causes a change in the operation at microwave frequency which is advantageous for various reasons:

- the adaptation can be obtained with a hard substrate having a large dimension a1, nearly twice the dimension known from the state of the art, thus sufficiently large for this substrate to be manufactured on a large scale;
- this hard substrate thus has the necessary dimensions for closing off the waveguide, that is to say, for creating a sealing for the line;
- the adaptation is obtained by narrowing the upper part of the waveguide, which is simple to realize and favourable to the sealing; the other narrowing 33*a* is not critical, because it serves to let the cavity 32*a* be rectangular;
- the use of the hard substrate makes it not only possible to seal the line cavity but also to realize good contacts on the line conductor by thermocompression;
- finally, opening 41 of the upper part 1, which is located in the sealing area of the line cavity 31, can accommodate a well protected integrated circuit without making this circuit bulky. Opening 41 is an extension towards the top of the microwave frequency cavity 31 of the line.

The problem posed when a substrate has as high a dielectric constant as a hard substrate (about 8 to 10) is that the cavity of the line and the cavity of the line-to-waveguide transition are to be considered very well, because more excitation takes place there of the higher modes which are centered at frequencies that are relatively close to those of the operating band and which constitute a phenomenon that renders the action of prior-art adapting system ineffective. The problem is thus to move the frequencies away from these higher modes.

This problem is solved by narrowing the upper part of the waveguide formed by the openings 22*a*, 32*a*. At the same time this solution makes it possible to obtain a frequency band widened towards the higher frequencies. Thus, this new adapting means makes it possible to obtain a better adaptation of the order of 22 dB at 70 GHz in lieu of the prior-art 15 dB, the possibility to operate at up to frequencies of the order of 100 GHz and, furthermore, a better sealing of the transition.

Those skilled in the art will select openings 22*a*, 32*a* which will, in effect, realize an undersized waveguide that makes it impossible for higher modes to occur at microwave frequencies, which frequencies are much higher than the frequencies at which one wishes to actually operate in the field of telecommunications; for example, higher than 110 Ghz. Thereto the person skilled in the art will select an undersized waveguide opening structure 22*a*, 32*a* which has a cut-off frequency just above the frequency at which one wishes to operate, then one will adjust the distance D to the short-circuit plane to optimize the coupling between the probe 25*a* at the end of the microstrip line, and the waveguide.

Thus, in the present device, in lieu of oversizing the waveguide relative to the line, as this was known from the state of the art, the problem is solved by undersizing the waveguide relative to the line. The inclusion of a hard substrate in the present device creates a deviation which is used for adapting the waveguide to the line. The undersizing of the waveguide makes it possible to position the intelligence bandwidth. The higher the sought frequency is, the more undersized the waveguide will be.

Hereinafter examples will be given of sizes suitable for realizing the various parts of the transition device as a function of the sought frequency.

FIGS. 2A–2D represent in planar views the various parts which form the transition as is represented in a sectional view in FIG. 1C. The elements shown in FIGS. 2A to 2D further make it possible to realize a double transition, that is to say, a transition by way of a microstrip transmission line between two waveguides which have cavities 102A, 102B with dimensions a1×a2 respectively. The various parts 1, 2, 3, 4 are metallic or metal plated sheets.

Figure 2A:
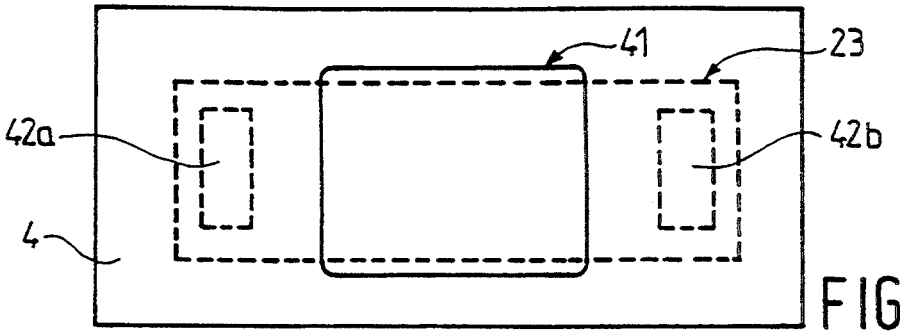
FIG. 2A represents a top view of an upper metallic sheet which is illustrated in part in FIG. 1C.
Figure 2B:
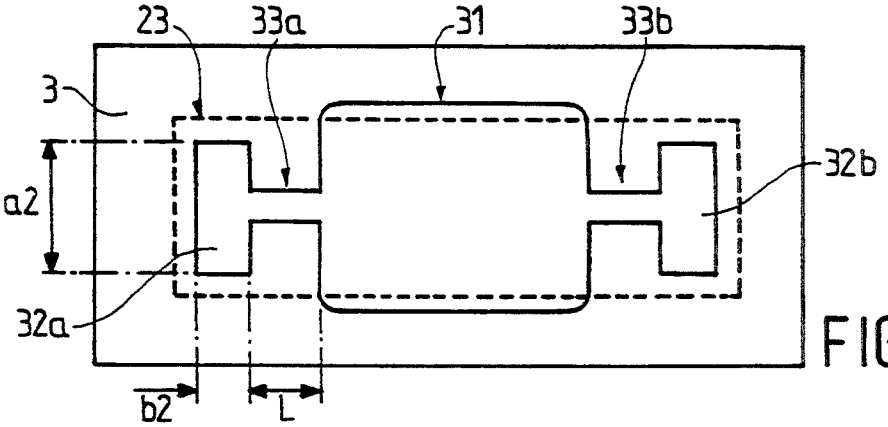
FIG. 2B represents a top view of an intermediate metallic sheet which is illustrated in part in FIG. 1C.
Figure 2C:
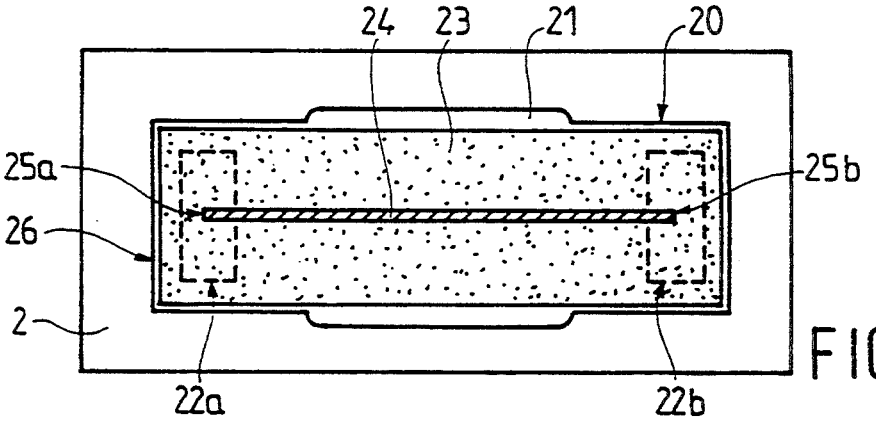
FIG. 2C represents a top view of a metallic substrate support sheet which is illustrated in part in FIG. 1C.
Figure 2D:
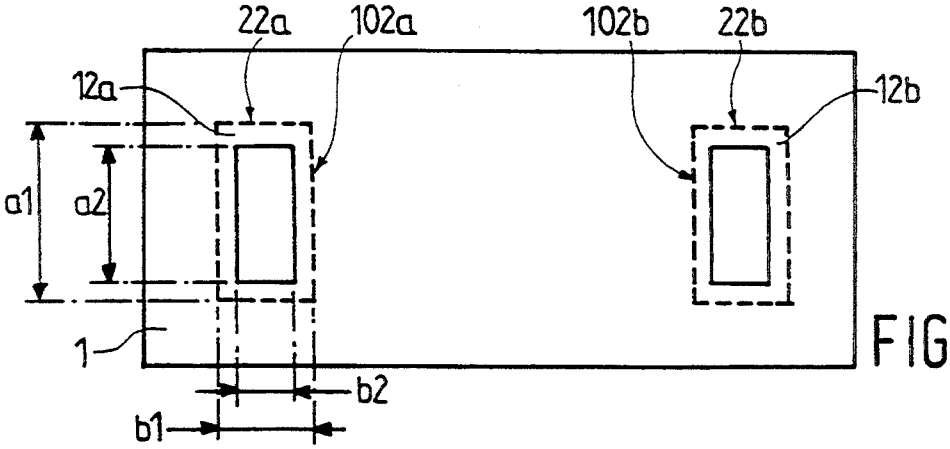
FIG. 2D represents a top view of a metallic base sheet which is illustrated in part in FIG. 1C. In a general way the FIGS. 2A–2D represent metallic sheets that can be assembled to realize a double transition between a transmission line and a waveguide.

FIG. 2D represents the lower sheet or base sheet 1 of the device, which shows the trace of two cavities in the form of truncated pyramids 12*a*, 12*b* respectively, which correspond to the transition in the form of a funnel between the waveguide cavities having the dimensions a 1×b1, and those of the undersized waveguides in the area comprised between the probe ends 25*a*, 25*b* and the short-circuits 42*a*, 42*b*.

FIG. 2C represents the support sheet 2 of the substrate 23. This support sheet has a groove 26 which has dimensions slightly larger than those of the substrate, rectangular, with widenings 21 on the large sides of the substrate, the small sides of the substrate being substantially equal to the large dimension a1 of the waveguides, and the large dimension of the substrate being suitable for accommodating a connection line between two waveguides, that is to say, at least 18 mm; the substrate is intended to be bonded onto the bottom 27 of the groove 26 which is thus to have a depth at least equal or substantially equal to the thickness of the substrate. During the bonding process the back surface of the substrate is bonded onto the bottom 27 of the groove 26 and the excessive bonding material is removed through the widenings 21. The substrate 23 can have a ground plane on its back surface in the part that is in contact with the bottom of the groove, or rather the bottom of this groove is used as a ground plane, with the bonding material being selected as the conductor. There is also an embodiment for a transmission line, called coplanar transmission line, in which the ground plane is provided on the same surface of the substrate as the line conductor.

The ends of the conductor 24, realized in the upper part of the substrate, extend substantially into the center of the cavities 22*a*, 22*b* of which outlines are shown in dashed lines in FIG. 2C.

FIG. 2B represents the upper intermediate sheet 3 with the recesses 32*a*, 32*b* for forming the narrowed (or undersized) waveguides while the narrowings 33*a*, 33*b* form the microwave frequency cavities of the transmission line, and the cavity 31 for accommodating an integrated circuit to be connected to the transmission line. The outline of the substrate 23 is represented in a dashed line in FIG. 2B. The thickness of this sheet 3 is D.

FIG. 2A represents the upper sheet 4 or lid which covers the microwave frequency cavity of the line and includes the short-circuit planar portions 42*a*, 42*b*. This upper sheet 4 is further sufficiently thick to accommodate a recess 41 suitable for containing the integrated circuit to be connected to the transmission line.

The various sheets 1, 2, 3, 4 as well as the waveguides 100 (not shown in FIGS. 2A–2D) are fixed to each other, for example, by screws, after the substrate 23 has been mounted and connected to the integrated circuit (which is not shown either), which circuit is positioned in cavity 41.

EMBODIMENTS

By way of non-limiting example there will be given hereinafter dimensions of the parts of the transition device described hereinbefore, to obtain operation in the frequency band from 50 to 90 GHz. These dimensions are given for a double transition of the type shown in FIGS. 2A–2D.

| | |
|---|---|
| a1 = 3.8 mm | b1 = 1.9 mm |
| a2 = 3.1 mm | b2 = 1.5 mm |
| L = 4 mm | |
| l = (b2/2) + (b2/10) | |
| D = 1.8 × 2.4 mm for a frequency of 55 GHz | |

Material of the substrate: aluminium ($Al_2O_3$)
Dielectric constant of the aluminium material $\epsilon=9.6$
Thickness of the aluminium substrate=0.127 mm
Width of the microstrip conductor=0.127 mm
Total length of the substrate=18 mm
Total width of the substrate=4 mm
Transversal dimension of the narrowing of the line cavity (33*a*, 33*b*)=1 mm
Mismatch losses for 2 transitions and the 18 mm line: 20 to 25 dB (better than the state of the art which attains 15 dB).
Insertion losses≈2.3 dB equivalent to the state of the art.

We claim:

1. A microwave frequency device for forming a transition between a transmission line, comprising a conductive strip supported on an electrically insulating substrate, and a waveguide end having an opening with a predefined cross-sectional area defining an end of a longitudinally extending cavity of the waveguide, said device comprising:

a. a first portion defining a first cavity extending in a first direction and having a first cross-sectional area, a first length of said transmission line being disposed in said first cavity and extending in said first direction;

b. a second portion defining a second cavity extending in a second direction transverse to the first direction from an electrically open end having the predefined cross-sectional area for coupling with the waveguide end to an electrically shorted end having a second cross-sectional area which is smaller than the predefined cross-sectional area;

c. a third portion defining a third cavity communicating with the first and second cavities, said third cavity extending in the first direction and having a third cross-sectional area which is smaller than the first cross-sectional area;

said transmission line extending in the first direction through the third cavity and ending in an electrically open probe portion disposed in the electrically shorted end of the second cavity.

2. A microwave frequency device as in claim 1 where the third cross-sectional area is smaller than the second cross sectional area.

3. A microwave frequency device as in claim 1 or 2 where the third cross-sectional area is uniform along the entire extent of the third cavity.

4. A microwave frequency device as in claim 1 or 2 where the substrate extends across the entire cross-sectional area of the second cavity.

5. A microwave frequency device as in claim 1 or 2 where the substrate has a first side supporting the conductive strip and an opposite second side supporting a conductive ground plane which is disposed in contact with a conductive surface of said device.

6. A microwave frequency device as in claim 5 where the first cavity forms part of a sealed housing for containing an integrated circuit to be electrically connected to the transmission line.

7. A microwave frequency device as in claim 1 or 2 comprising a plurality of stacked plates having conductive surfaces which are shaped to cooperatively form at least one of the first, second and third cavities.

8. A microwave frequency device as in claim 7 where:

a. at least one of the stacked plates forms a supporting surface for the ground plane side of the substrate and forms the electrically open end of the second cavity; and b. at least a different one of the stacked plates forms the first cavity, the electrically shorted end of the second cavity, and the third cavity.

9. A microwave frequency device as in claim 8 where the electrically open end of the second cavity includes:

a. a transitional area portion in which the cross-sectional area decreases from the predefined cross-sectional area to the second cross-sectional area; and b. a uniform area portion in which the cross-sectional area is uniform and equal to the second cross-sectional area.

10. A microwave frequency device as in claim 9 where the substrate extends across and closes the uniform area portion.

11. A microwave frequency device as in claim 7 where the stacked plates include:

a. an intermediate plate having openings corresponding to at least portions of the first cavity, the electrically shorted end of the second cavity, and the third cavity; and b. a cover plate having conductive surfaces extending over said openings in the intermediate plate.

12. A microwave frequency device as in claim 11 where the cover plate includes a recessed portion forming part of the first cavity.

13. A microwave frequency device as in claim 11 where the intermediate plate has a thickness which establishes a predetermined separation between the probe portion and the conductive surface of the cover plate extending over the opening in the intermediate plate which corresponds to at least a portion of the electrically shorted end of the second cavity.

14. A microwave frequency device as in claim 11 where the stacked plates include:

a. a support plate having a supporting surface for the ground plane side of the substrate and having an opening forming a portion of the electrically open end of the second cavity in which the cross-sectional area is uniform and equal to the second cross-sectional area; and b. a base plate having an opening forming a portion of the electrically open end of the second cavity in which the cross-sectional area decreases from the predefined cross-sectional area to the second cross-sectional area.

15. A microwave frequency device for forming a transition between a transmission line, comprising a conductive strip supported on an electrically insulating substrate, and a pair of waveguide ends, each having an opening with a predefined cross-sectional area defining an end of a longitudinally extending cavity of the respective waveguide, said device comprising:

a. a first portion defining a first cavity extending in a first direction and having a first cross-sectional area, a first length of said transmission line being disposed in said first cavity and extending in said first direction;

b. a pair of second portions, each defining a respective second cavity extending in a second direction transverse to the first direction from an electrically open end having the predefined cross-sectional area for coupling with a respective one of the waveguide ends to an electrically shorted end having a second cross-sectional area which is smaller than the predefined cross-sectional area;

c. a pair of third portions, each defining a respective third cavity communicating with the first cavity and a respective one of the second cavities, each said third cavity extending in the first direction and having a third cross-sectional area which is smaller than the first cross-sectional area;

said transmission line extending in the first direction through each of the third cavities and ending in electrically open probe portions disposed in respective ones of the electrically shorted ends of the second cavities.

16. A microwave frequency device as in claim 15 where the third cross-sectional area is smaller than the second cross sectional area.

* * * * *